US009912058B2

(12) United States Patent
Palm et al.

(10) Patent No.: US 9,912,058 B2
(45) Date of Patent: Mar. 6, 2018

(54) HYBRID ANTENNA, ANTENNA ARRANGEMENT AND METHOD FOR MANUFACTURING AN ANTENNA ARRANGEMENT

(71) Applicant: Infineon Technologies AG, Neubiberg (DE)

(72) Inventors: Petteri Palm, Regensburg (DE); Martin Buchsbaum, Graz (AT); Josef Gruber, St. Ruprecht (AT); Juergen Hoelzl, Graz (AT); Frank Pueschner, Kelheim (DE); Peter Stampka, Burglengenfeld (DE)

(73) Assignee: Infineon Technologies AG, Neubiberg (DE)

( * ) Notice: Subject to any disclaimer, the term of this patent is extended or adjusted under 35 U.S.C. 154(b) by 425 days.

(21) Appl. No.: 14/519,166

(22) Filed: Oct. 21, 2014

(65) Prior Publication Data

US 2016/0111787 A1 Apr. 21, 2016

(51) Int. Cl.
*H01Q 7/08* (2006.01)
*H01Q 1/24* (2006.01)
*H01Q 21/24* (2006.01)

(52) U.S. Cl.
CPC ..... *H01Q 7/08* (2013.01); *H01Q 1/243* (2013.01); *H01Q 21/24* (2013.01)

(58) Field of Classification Search
CPC ..... H01Q 7/08; H01Q 1/243; H01Q 21/24
USPC ..... 343/788
See application file for complete search history.

(56) References Cited

U.S. PATENT DOCUMENTS 6,163,305 A * 12/2000 Murakami ..... H01Q 7/08 343/788
2008/0238799 A1* 10/2008 Tsushima ..... H01Q 1/2216 343/788
2009/0096694 A1* 4/2009 Ito ..... G06K 19/07749 343/788
2011/0050531 A1* 3/2011 Yamaguchi ..... H01Q 1/2216 343/842
2012/0127049 A1* 5/2012 Kato ..... H01P 1/20345 343/749
2013/0147675 A1* 6/2013 Kato ..... H01Q 1/38 343/788
2014/0176384 A1* 6/2014 Yosui ..... H01Q 7/06 343/788
2014/0253404 A1* 9/2014 Ikemoto ..... H01Q 1/40 343/788
2015/0214622 A1* 7/2015 Tenno ..... H01Q 1/38 343/702

OTHER PUBLICATIONS

AS3922; NFC Tag Front-end with "Active Boost" Technology; www.ams.com/AS3922; pp. 1-56, printed out Oct. 23, 2014.

* cited by examiner

*Primary Examiner* — Dameon E Levi
*Assistant Examiner* — David Lotter
(74) *Attorney, Agent, or Firm* — Viering, Jentschura & Partner mbB

(57) ABSTRACT

According to one embodiment, a hybrid antenna is described comprising a plurality of windings wherein each winding comprises a loop antenna portion arranged in a plane and a ferrite antenna portion arranged at least partially outside of the plane.

23 Claims, 16 Drawing Sheets

HYBRID ANTENNA, ANTENNA ARRANGEMENT AND METHOD FOR MANUFACTURING AN ANTENNA ARRANGEMENT

TECHNICAL FIELD

The present disclosure relates to hybrid antennas, antenna arrangements and methods for manufacturing an antenna arrangement.

BACKGROUND

Mobile communication like for example mobile phones increasingly support near filed communication (NFC). The functionality of the near field communication can be provided in a mobile device for example by means of a SIM (subscriber identity module) or a memory card, for example a MicroSD memory card. For this, approaches are desirable which allow an efficient implementation of an NFC functionality on a module with small form factor.

SUMMARY

According to one embodiment, a hybrid antenna is provided including a plurality of windings wherein each winding includes a loop antenna portion arranged in a plane and a ferrite antenna portion arranged at least partially outside of the plane.

According to another embodiment, an antenna arrangement is provided including a substrate, a loop antenna formed on a layer of the substrate and a ferrite antenna including a ferrite core embedded within the layer of the substrate and including at least one winding, wherein the loop antenna is connected to the at least one winding and the at least one winding is formed by through-holes through the layer of the substrate and a routing connection between the through-holes on or below the layer of the substrate.

According to a further embodiment, a method for manufacturing an antenna arrangement as described above is provided.

BRIEF DESCRIPTION OF THE DRAWINGS

In the drawings, like reference characters generally refer to the same parts throughout the different views. The drawings are not necessarily to scale, emphasis instead generally being placed upon illustrating the principles of the invention. In the following description, various aspects are described with reference to the following drawings, in which.

DESCRIPTION

The following detailed description refers to the accompanying drawings that show, by way of illustration, specific details and aspects of this disclosure in which the invention may be practiced. Other aspects may be utilized and structural, logical, and electrical changes may be made without departing from the scope of the invention. The various aspects of this disclosure are not necessarily mutually exclusive, as some aspects of this disclosure can be combined with one or more other aspects of this disclosure to form new aspects.

For usage of NFC (near-field communication) in devices with a small form factor a NFC system can be used which may be based on a SIM (subscriber identity module) card or a MicroSD card. An example for a NFC system is shown in FIG. 1.

Figure 1:
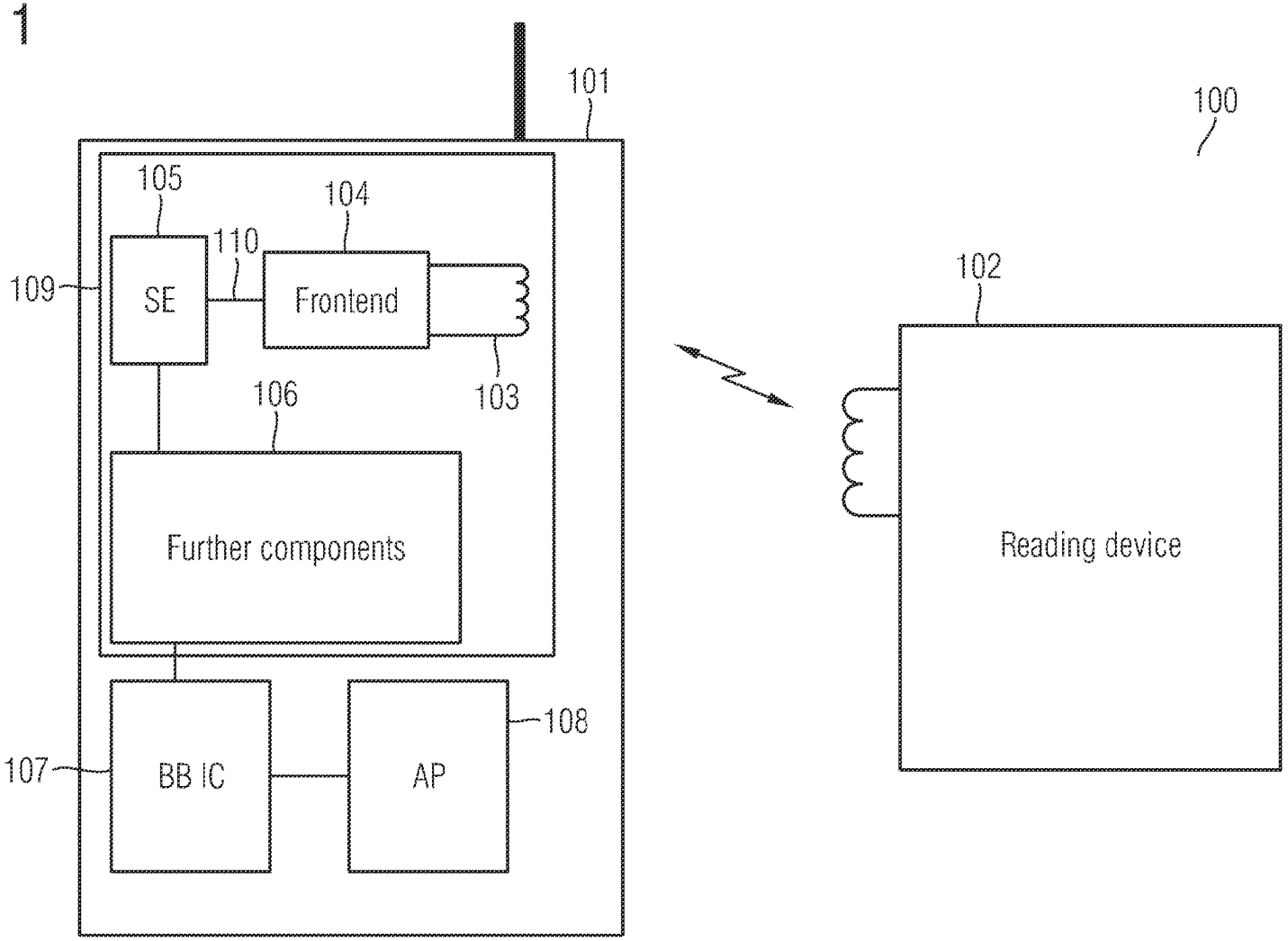
FIG. 1 shows a communication arrangement according to an embodiment.

FIG. 1 shows a communication arrangement 100 according to an embodiment.

The communication arrangement 100 includes a mobile phone 101 and a NFC reading device 102 (also referred to as wireless reader).

The mobile phone includes a (NFC) antenna 103, which is coupled via a (NFC) frontend 104 with a secure element or security element (SE) 105.

The SE 105 is coupled to further components 106 such as a flash memory or a flash controller, for example in accordance with ISO/IEC 7816. For example, a flash controller is arranged between the SE 105 and a BB IC (baseband IC) 107 which tunnels the communication according to ISO/IEC 7816 between the BB IC 107 and the SE 105. A flash memory is for example coupled to the flash controller (but not with the SE 105) and is for example controlled by means of a different protocol than ISO/IEC 7816.

The further components 106 are coupled with mobile phone components such as the BB IC 107, which in turn communicates with applications running on an application processor (AP) 108.

A signal transmitted by the reader 102 to the mobile phone 101, for example according to ISO/IEC 14443, is amplified by the frontend 103 and is forwarded to the SE 105 by means of a wired interface 110 based on the ISO/IEC 14443 protocol. The interface can for example be a DCLB (Digital Contactless Bridge) interface or an ACLB (Advanced Contactless Bridge) interface.

The SE 105 sends a response (e.g. after communication with the BB IC 107) back to the frontend 104 which amplifies the signal received from the SE 105 by means of active modulation using the battery voltage of the mobile phone 101 and transmits the signal via the wireless interface between the mobile phone 101 and the reader 102.

The further components 106, the SE 105, the frontend 104 and the antenna 103 can be arranged together on a module, e.g. a SIM card, a micro SIM card, a nanoSIM card or a MicroSD card directly in the mobile phone 101 or can be included on a PCB (printed circuit board), e.g. in a watch. In such a scenario, there is however the difficulty that in an implementation of a NFC functionality on a module (e.g. a chip card) with small form factor the metallic environment like the socket, the battery or the housing (e.g. a metallic back cover) can negatively influence the wireless communication.

This can be addressed by means of a PCB loop antenna. However, in this case, there is only one principal direction and a wireless communication may not be possible in case the SIM card or the microSD card including the PCB loop antenna is located beneath a metallic surface e.g. a battery.

Further, the above issue can be addressed by means of a ferrite antenna. However, this typically results in a limited communication distance in the principal direction (z direction).

Another approach is a combination of a ferrite antenna and a PCB loop antenna. This is illustrated in FIG. 2.

Figure 2:
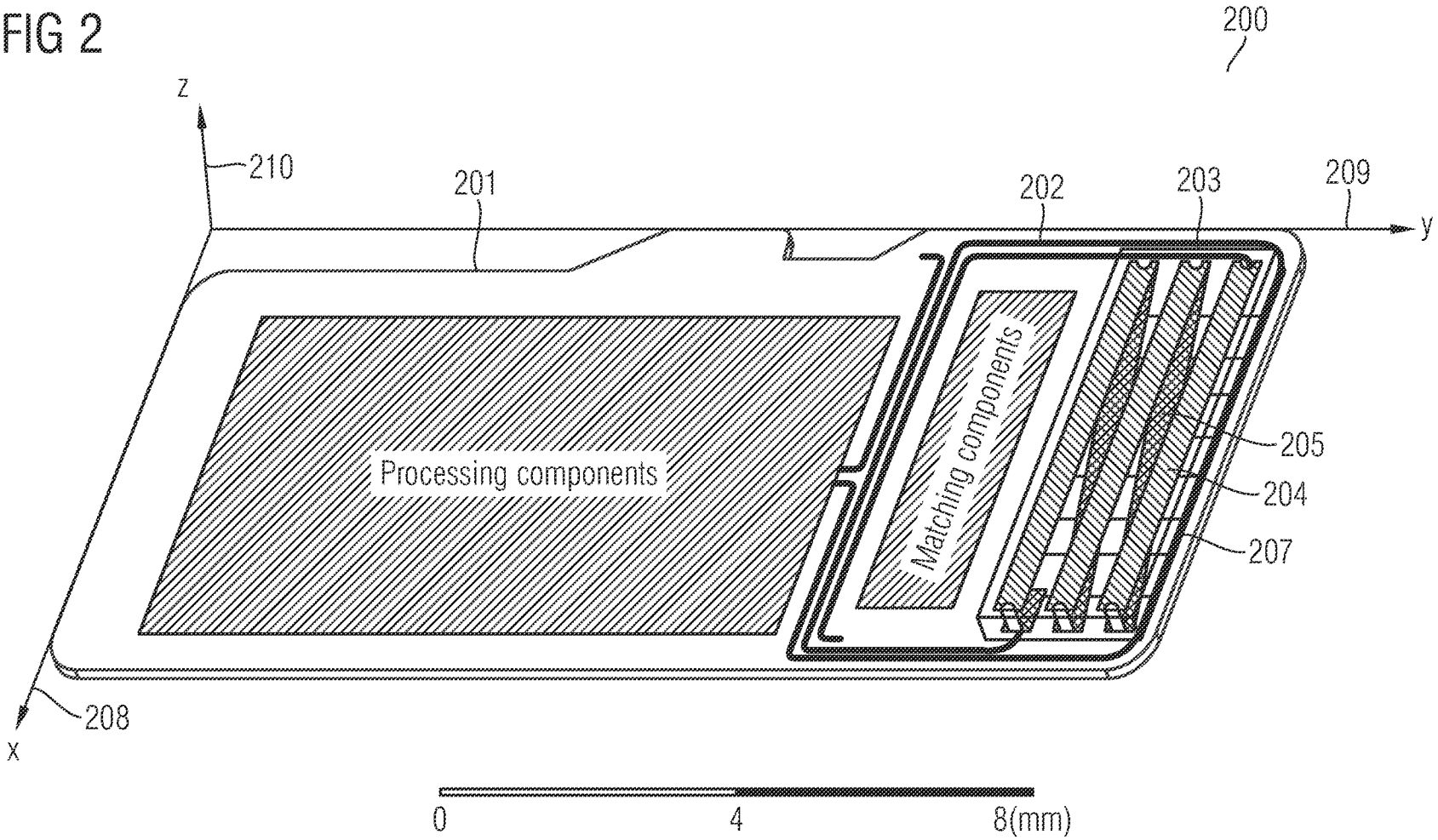
FIG. 2 shows a microSD card.

FIG. 2 shows a microSD card 200.

The micro SD card 200 includes a substrate 201. A loop antenna (e.g. a PCB loop antenna) 202 is formed on the substrate 201. The loop antenna 202 is coupled to a ferrite antenna 203 which is mounted on the substrate. The ferrite antenna 203 includes windings surrounding a ferrite core. The windings are formed by top routing connections 204 (shown with a diagonal hatching) and bottom routing connections 205 (shown with a cross hatching).

It should be noted that the ferrite antenna 203 is coupled serially to the loop antenna 202: a first winding of the loop antenna 202 goes through the ferrite antenna 203 while a second winding 207 goes around the ferrite antenna 203.

In FIG. 2, a first axis 208 indicates x direction, a second axis 209 indicates y direction and a third axis 210 indicates z direction.

However, the approach illustrated in FIG. 2 may still suffer from a high attenuation because of the metallic environment for small form factors such as microSIM which leads to a low quality factor of the antenna (formed by the combination of loop antenna and ferrite antenna). Further, the coupling factor and the communication performance are typically limited when a large part of the microSD card (or SIM card) is covered with the socket (e.g. up to 90% as it is the case in some mobile phones).

According to one embodiment, an RFID multipath propagation antenna is provided which allows a high communication performance also in a difficult environment.

Figure 3:
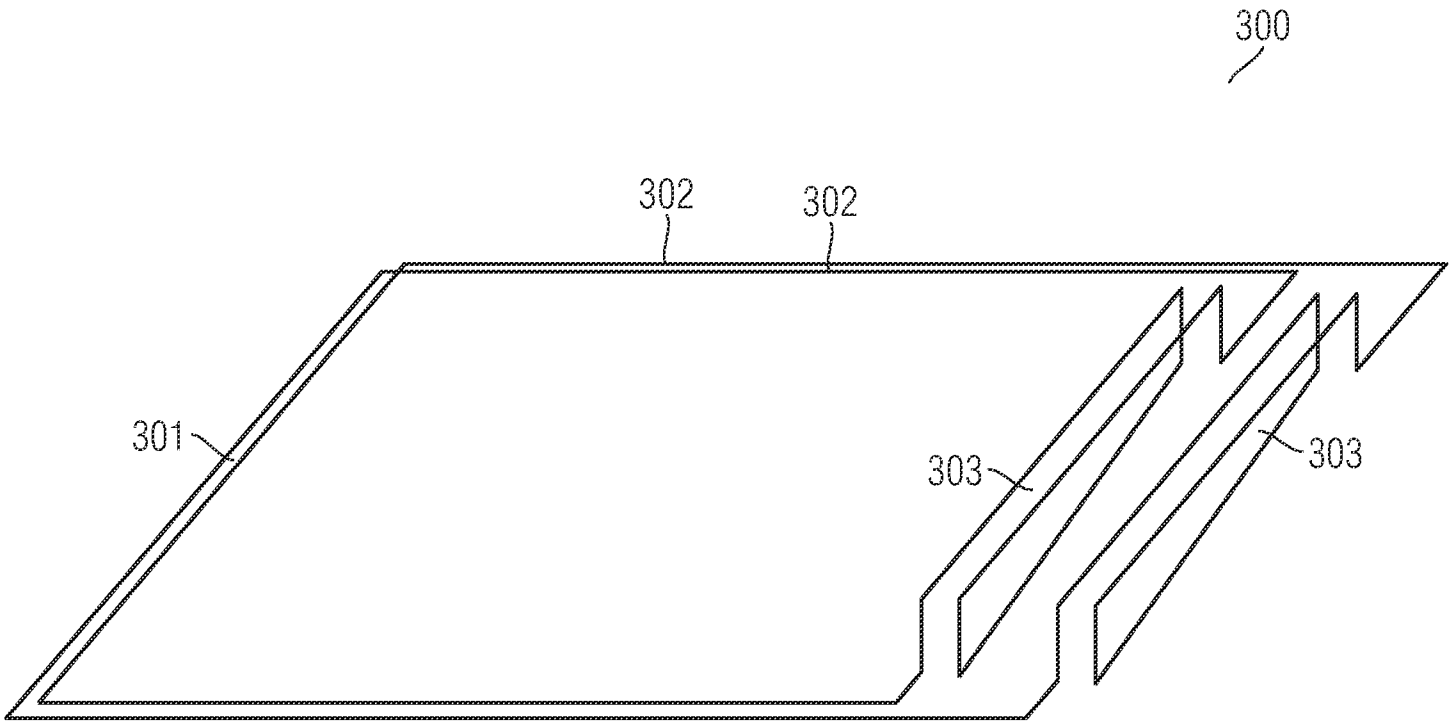
FIG. 3 shows a hybrid antenna according to an embodiment.

FIG. 3 shows a hybrid antenna 300 according to an embodiment.

The hybrid antenna 300 includes a plurality of windings 301 wherein each winding includes 301 a loop antenna portion 302 arranged in a plane and a ferrite antenna portion 303 arranged at least partially outside of the plane (e.g. above or below the plane).

According to one embodiment, in other words, each of a plurality of windings includes a section formed by a loop antenna and a second formed by a ferrite antenna (wherein the loop antenna and the ferrite antenna have different orientations). Thus, the ferrite antenna is not connected in series with the loop antenna but a part of the ferrite antenna is connected within each winding. The term "hybrid antenna" may be seen to refer to the fact that the antenna is a combination of a loop antenna and a ferrite antenna (arranged with different orientations).

According to one embodiment, a ferrite antenna is provided designed for the combination with a PCB loop antenna, which allows saving area of the PCB which can for example be used for the matching network of the antenna and which allows an enhanced antenna quality factor and a higher coupling factor to a reader antenna (e.g., as shown in simulation of one embodiment, an increase of antenna quality factor of 30% and of the coupling factor of up to 20%).

According to one embodiment, the ferrite antenna portions are ferrite antenna windings surrounding a ferrite antenna core.

The ferrite antenna windings and the ferrite antenna core may form a ferrite antenna.

According to one embodiment, at least one winding of the plurality of windings includes a ferrite antenna portion formed by a plurality of ferrite antenna windings.

According to one embodiment, the ferrite antenna includes for each winding a first terminal and a second terminal connected by means of the ferrite antenna section and the loop antenna section is connected to the ferrite antenna section by means of the first terminal and the second terminal.

The first terminals for different windings are for example different and the second terminals for different windings are for example different.

According to one embodiment, the plane is a layer or a surface of a substrate.

The plane is for example a layer or a surface of a printed circuit board.

According to one embodiment, the windings encircle an area of the substrate which is at least partially free of ferrite.

The ferrite antenna portion is for example arranged at least partially perpendicular to the plane.

According to one embodiment, at least one winding of the plurality of windings includes a ferrite antenna portion which includes a higher number of conductors outside of the plane than it includes conductors in the plane.

The conductors outside of the plane are for example conductors on top of a ferrite antenna core and the conductors in the plane are for example conductors below the ferrite antenna core.

For example, according to one embodiment a (hybrid) antenna is provided including a loop antenna portion including a plurality of windings disposed in a plane, and a ferrite antenna portion including a ferrite core and a plurality of windings disposed around the ferrite core, the windings disposed at least partially outside of the plane, wherein the windings of the loop antenna portion are electrically connected to the windings of the ferrite antenna. The windings of the loop antenna portion are for example contiguous. The windings of the ferrite antenna portion are for example arranged (substantially) orthogonally to the plane. Thus, the ferrite antenna has a different principal direction than the loop antenna such that for example a multidirectional antenna is provided including a loop antenna having a plurality of windings defining a first directional bias and a ferrite antenna having a plurality of windings disposed within a ferrite core, the ferrite antenna defining a second directional bias different from the first directional bias. The first directional bias is for example generally orthogonal to the second directional bias.

In the following, embodiments of the antenna arrangement 300 are described in more detail.

Figure 4:
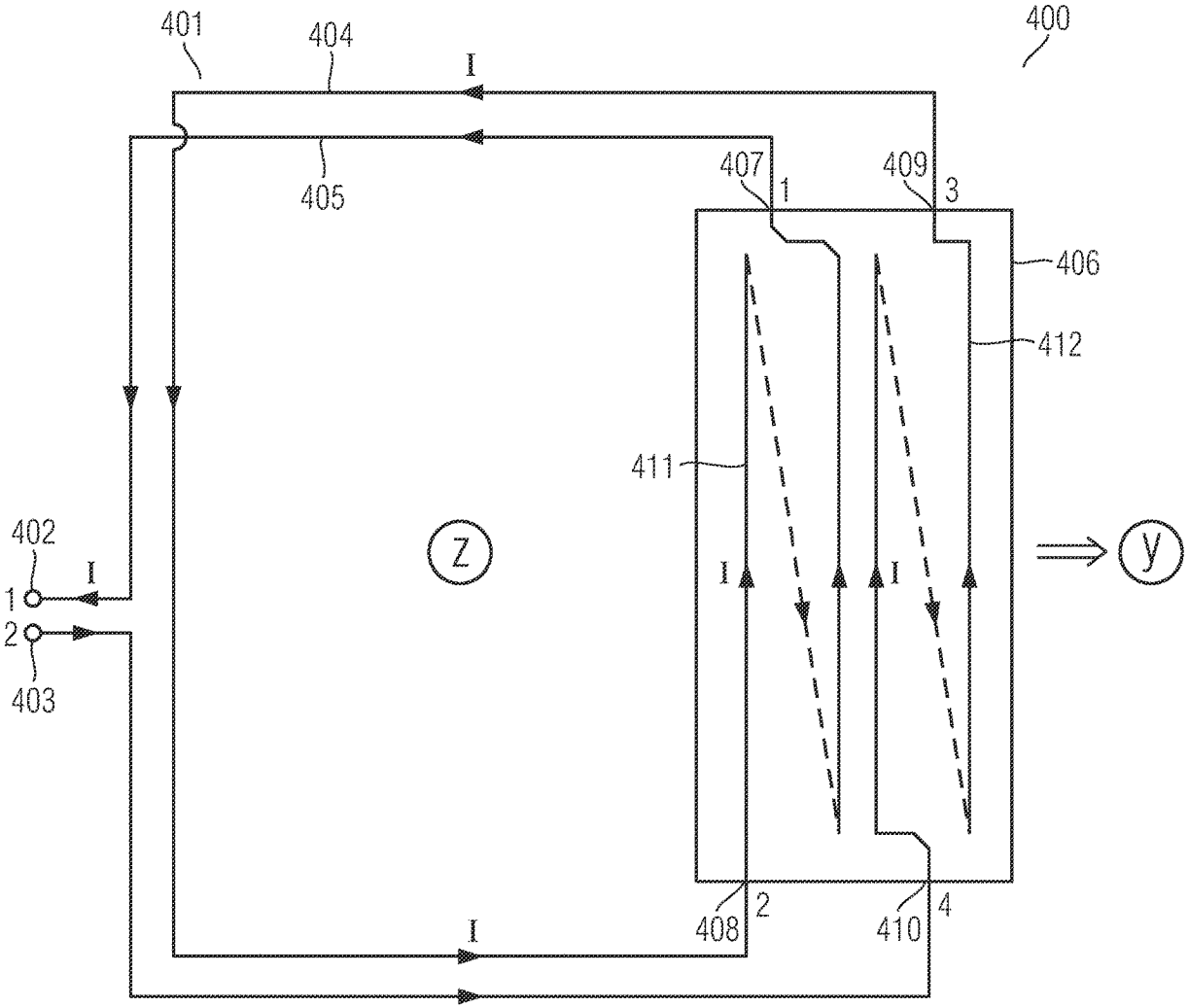
FIG. 4 shows a (hybrid) PCB/ferrite multipath propagation antenna according to one embodiment.

FIG. 4 shows a (hybrid) PCB/ferrite multipath propagation antenna 400 according to one embodiment.

The antenna 400 is arranged on a PCB (or generally a substrate), for example of a chip cards such as a SIM card or a microSD card. The antenna 400 includes a PCB (loop) antenna 401 with input terminals 402, 403. In this example, the loop antenna includes a first winding 404 and a second winding 405.

The antenna 400 further includes a ferrite antenna 406. The ferrite antenna 406 includes four terminals: a first terminal 407, a second terminal 408, a third terminal 409 and a fourth terminal 410.

The ferrite antenna includes a first winding 411 which connects the first terminal 407 with the second terminal 408 and a second winding 412 which connects the third terminal 409 and the fourth terminal 410. The parts of the windings 411, 412 which are on top of the ferrite antenna 406 are shown with solid lines and the parts of the windings 411, 412 which are on bottom of the ferrite antenna 406 are shown with dashed lines.

The first winding 404 of the loop antenna is connected with the first terminal 407 and the second terminal 408 such that the first winding 404 of the loop antenna connects to the first winding 411 of the ferrite antenna. In other words, the first winding 411 of the ferrite antenna completes the first winding 404 of the loop antenna to form a first winding of the resulting hybrid antenna 400 or the first winding 404 of the hybrid antenna 400 extends through the ferrite antenna by means of the first winding 411 of the ferrite antenna.

The second winding 405 of the loop antenna is connected with the third terminal 409 and the fourth terminal 410 such that the second winding 405 of the loop antenna connects to the second winding 412 of the ferrite antenna. In other words, the second winding 412 of the ferrite antenna completes the second winding 405 of the loop antenna to form a second winding of the resulting hybrid antenna 400 or the second winding 405 of the hybrid antenna 400 extends through the ferrite antenna by means of the second winding 412 of the ferrite antenna.

The arrowheads show an exemplary current direction through the windings. The principal communication directions of the antenna 400 are indicated by a Z axis and a Y axis.

Figure 5:
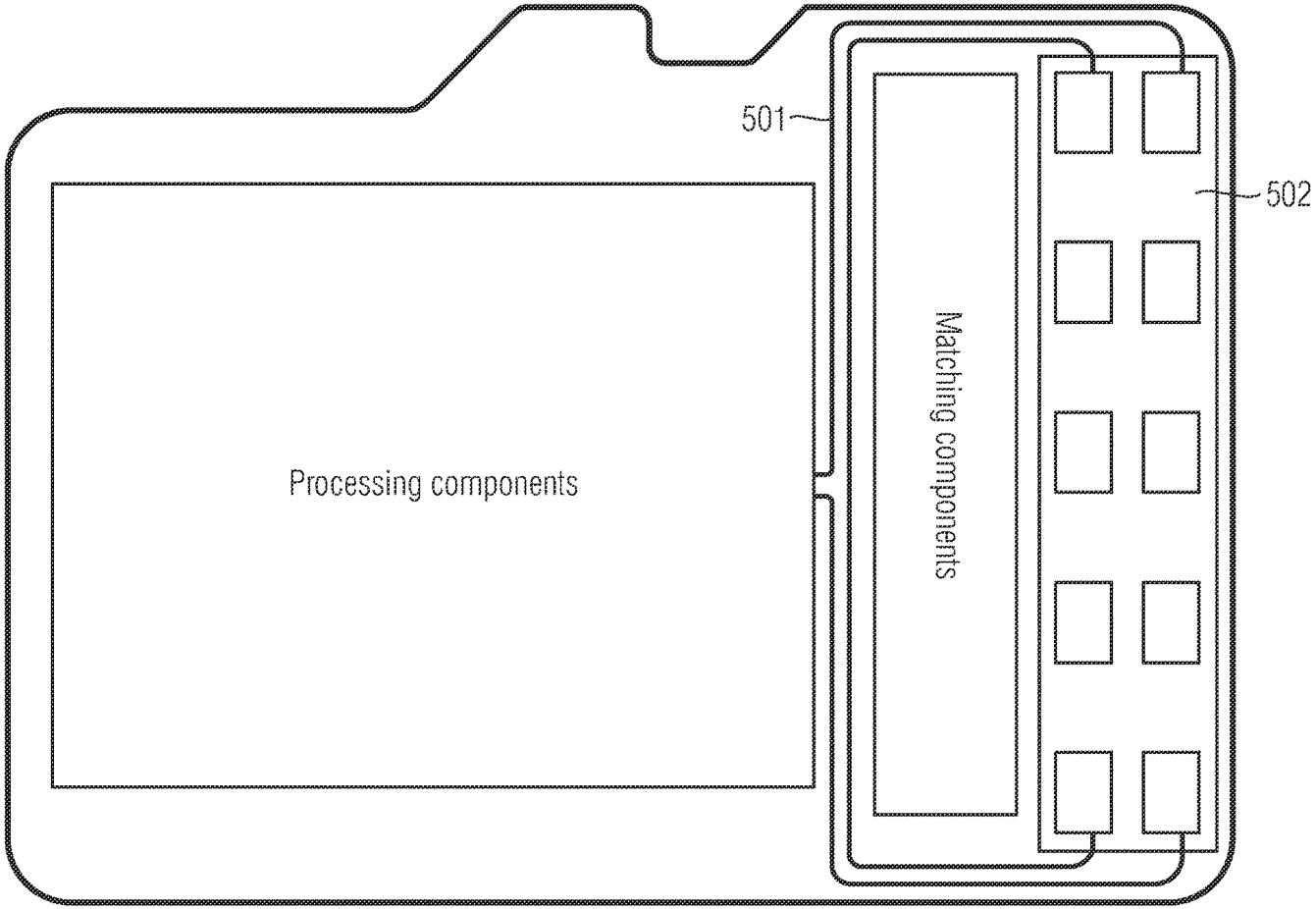
FIG. 5 shows a chip card including an antenna according to an embodiment.

FIG. 5 shows a chip card 500 including an antenna according to an embodiment.

The antenna of the chip card 500 for example corresponds to the antenna 400 and includes a loop antenna 501 with two windings and a ferrite antenna 502 placed in the hatched region. As explained with reference to FIG. 4, each of the two windings of the loop antenna 501 is connected to the ferrite antenna 502 such that four terminals of the ferrite antenna are used, in contrast to the example of FIG. 2, where only two terminals of the ferrite antenna are used for connecting the loop antenna and the ferrite antenna.

Figure 6:
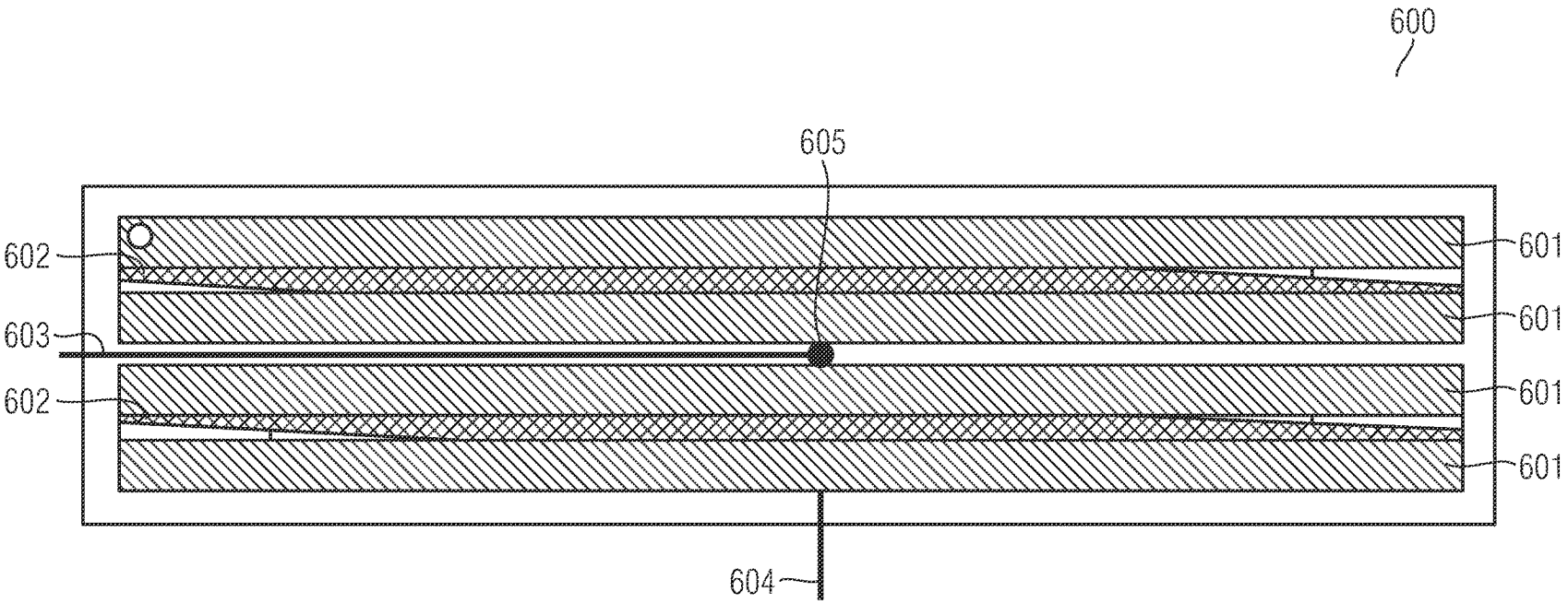
FIG. 6 shows a top view of a ferrite antenna according to an embodiment.
Figure 7:
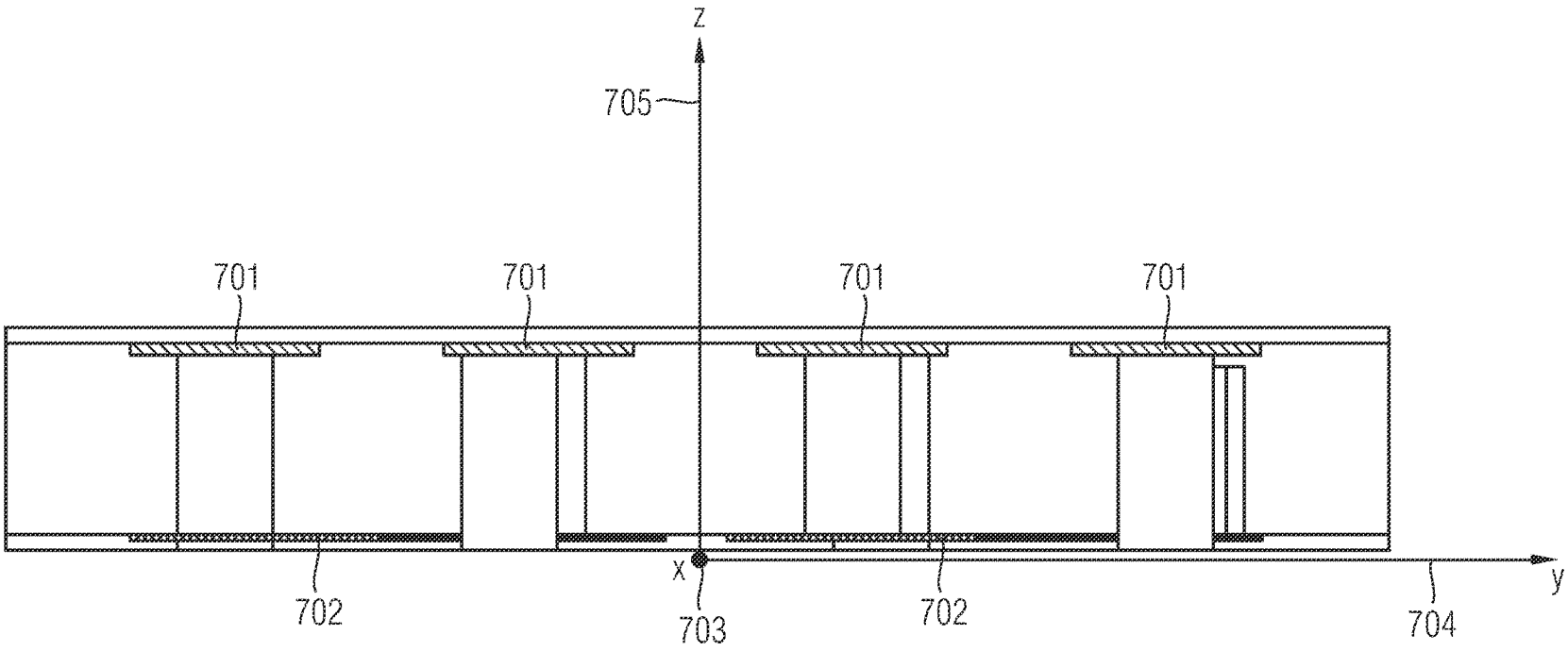
FIG. 7 shows a side view of the ferrite antenna of FIG. 6.

An example for the structure of the ferrite antenna 502 is shown in more detail in FIGS. 6 and 7.

FIG. 6 shows a top view of a ferrite antenna according to an embodiment.

FIG. 7 shows a side view of the ferrite antenna of FIG. 6.

The ferrite antenna 600, 700 in this example has four conductors 601, 701 on the top layer and two conductors 602, 702 on the bottom layer.

In FIG. 6, a first axis 603 indicates x direction, a second axis 604 indicates y direction and a dot 605 indicates z direction (extending out of the drawing plane).

In FIG. 7, a dot 703 indicates x direction (extending out of the drawing plane), a first axis 704 indicates y direction and a second axis 705 indicates z direction.

In its basic design, the ferrite antenna has at least two terminals but it may have more (4, 6, 8, 10, 12 etc.). Further, the terminals form pairs wherein the terminals of each pair are connected by at least one winding around the ferrite antenna core (e.g. 2, 3, 4, 5, 6 etc.)

According to one embodiment, the ferrite antenna has, as illustrated in FIGS. 6 and 7, a higher number of conductors on the top layer than on the bottom wherein the number of the conductors depends on the number of terminals and the number of windings around the ferrite core per terminal pair. In the example shown in FIGS. 6 and 7, the number of conductors on the top layer is given by the number of terminals of the ferrite antenna (which is four) times the number of windings of the ferrite antenna per terminal (which is one). The number of conductors on the lower layer is given by the number of conductors on the top layer minus the number of terminals on one side of the ferrite antenna (which is two).

In the design illustrated in FIGS. 6 and 7, the current flows through the loop antenna and the conductors on the top layer (e.g. top side) of the ferrite antenna clockwise or counter-clockwise such that the field components add together in the center of the ferrite antenna and do not cancel themselves. This means that the current flows in the same direction for all the bottom conductors (i.e. the conductors on the bottom layer) but in the opposite direction to the current through the top conductors (i.e. the conductors on the top layer). The number of windings of the loop antenna is given by the number of terminals of the ferrite antenna divided by two.

The design illustrated in FIGS. 6 and 7 allows an increase of the number of current-carrying conductors on the top layer of the ferrite antenna. Since these conductors have for example a certain distance to a metallic basis such as a copper PCB and are shielded by the ferrite core of the ferrite antenna this allows a reduction of attenuation by the generated opposing fields. Further, the coupling factor to a reader antenna can be increased compared to a design where the windings of the loop antenna are arranged below the ferrite core and these windings have a current direction opposite to the one of the bottom conductors of the ferrite antenna, which is not the case in the design illustrated in FIGS. 6 and 7. The design further allows saving area on the PCB since the loop antenna windings only go to the ferrite antenna (instead, as illustrated in FIG. 2, around the ferrite antenna). Thus, the ferrite core may be placed nearer to the PCB edge which allows saving area and a further increase of the coupling factor.

In summary, the hybrid antenna of FIG. 3, e.g. in the design illustrated in FIGS. 6 and 7 can be seen as a combination of a (PCB) loop antenna without (or at least reduced) negative mutual effect of the two antennas. It allows an increase of the number of conductors on the top side of the ferrite antenna core which allows improving the coupling factor and the quality factor of the antenna as well as saving area on the PCB.

According to a further embodiment, an approach for manufacturing a simply and low cost antenna module including a loop antenna and a ferrite antenna in the same package, e.g. for an NFC application, is provided.

Figure 8:
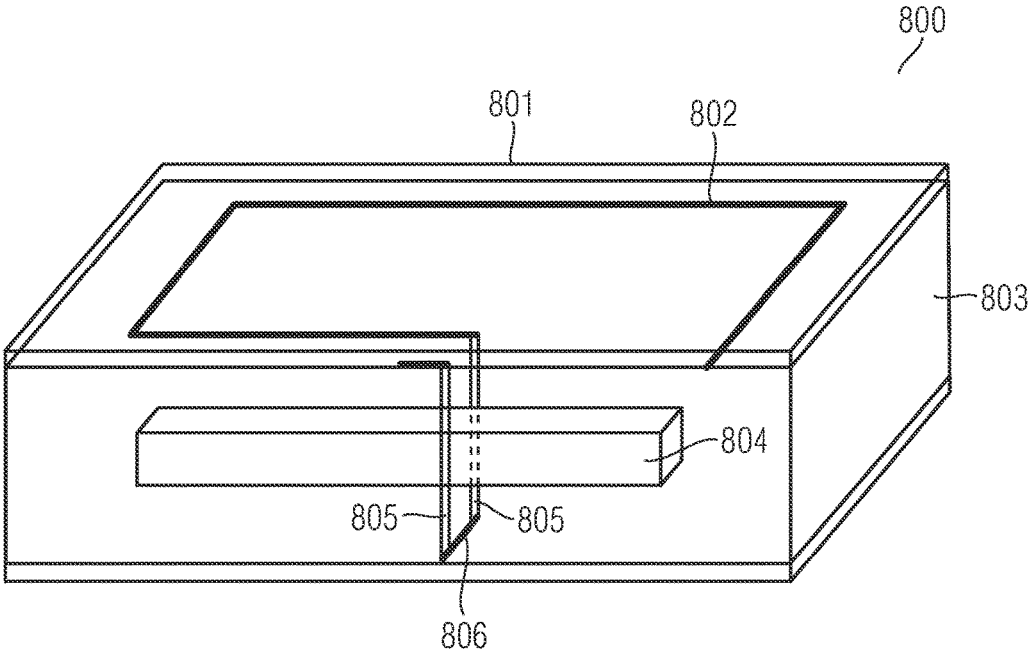
FIG. 8 shows an antenna arrangement according to an embodiment.

FIG. 8 shows an antenna arrangement 800 according to an embodiment.

The antenna arrangement 800 includes a substrate 801 and a loop antenna 802 formed on a layer 803 of the substrate.

The antenna arrangement 800 further includes a ferrite antenna including a ferrite core 804 embedded within the layer of the substrate and including at least one winding, wherein the loop antenna 802 is connected to the at least one winding and the at least one winding is formed by through-holes 805 through the layer 803 of the substrate and a routing connection 806 between the through-holes on or below the layer of the substrate.

According to one embodiment, in other words, an arrangement of a loop antenna and a ferrite antenna is provided in which the ferrite antenna is embedded in a substrate by forming the windings of the ferrite antenna by means of through-holes and conductors connecting the through-holes on the top layer and/or bottom layer of the substrate.

For example, the ferrite core of a ferrite antenna is embedded inside a PCB (printed circuit board) laminate using e.g. a Double Blade or Chip in Core manufacturing process and the wiring around the ferrite core is manufactured using plated through holes and copper wiring on top of the PCB board. According to one embodiment, the antenna arrangement is included in an antenna or communication module which includes the embedded ferrite core antenna and a loop antenna on the top of the laminate and connection terminals (e.g. solder pads on bottom side) to connect the antenna module to electronic components of the module. The module may be manufactured utilizing a low cost double side PCB manufacturing processes and common PCB material. It should be noted that in addition to a separate antenna module the antenna module can also be integrated to a PCB board where some other components would also be mounted.

The layer of the substrate is for example a core layer of the substrate.

The through-holes and the routing connection may be arranged such that the at least one winding encircles the ferrite core.

The through-holes for example include a conductive material. For example, the through-holes are plated with conductive material or filled with conductive material.

According to one embodiment, the at least one winding is formed by two through-holes and a routing connection arranged on the layer connecting the through-holes and a routing connection arranged below the layer connecting one of the through-holes to a further through-hole or is formed by two through-holes and a routing connection arranged below the layer connecting the through-holes and a routing connection arranged on the layer connecting one of the through-holes to a further through-hole.

For example, the loop antenna encloses an area of the substrate in which the ferrite antenna core is embedded.

The substrate is for example a laminate.

According to one embodiment, the antenna arrangement includes a plurality of windings, wherein each winding is formed by through-holes through the layer of the substrate and a routing connection between the through-holes on or below the layer of the substrate.

Figure 9:
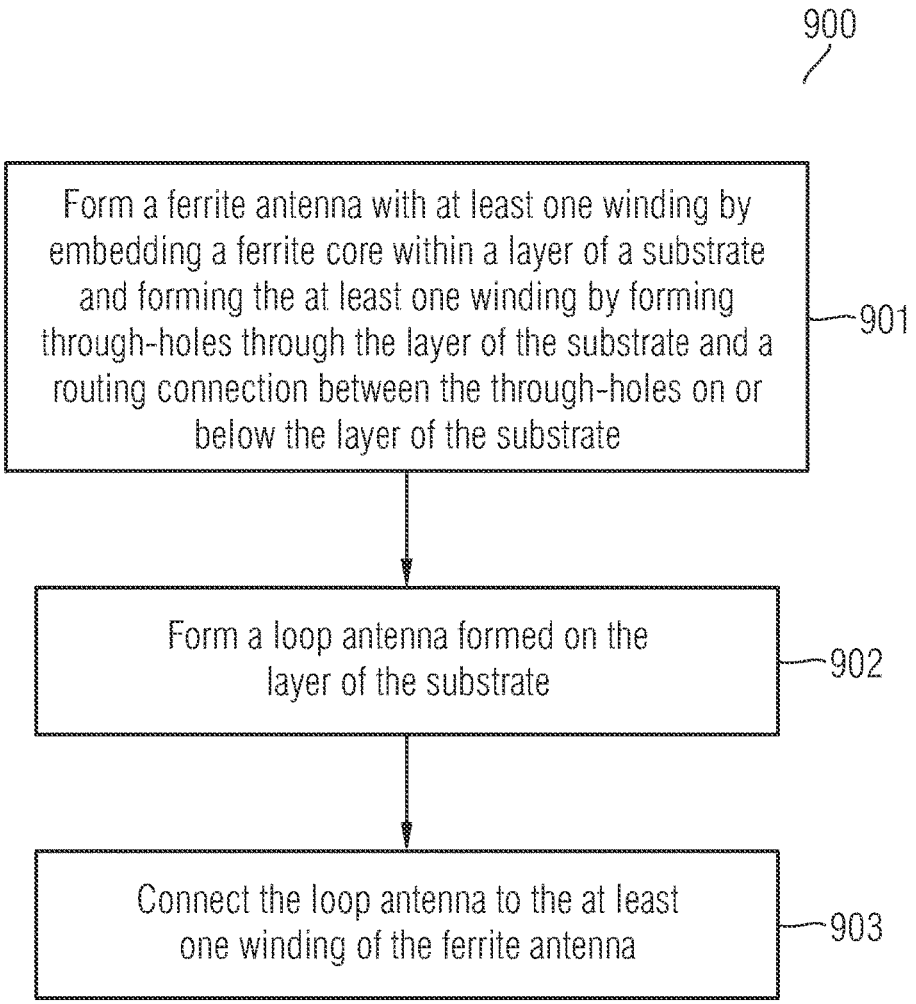
FIG. 9 shows a flow diagram.

The antenna arrangement for example further includes further routing connections on or below the layer of the substrate serially connecting the plurality of windings The antenna arrangement 800 is for example manufactured using a manufacturing process as illustrated in FIG. 9.

FIG. 9 shows a flow diagram 900.

The flow diagram 900 illustrates a method for manufacturing an antenna arrangement.

In 901, a ferrite antenna with at least one winding is formed by embedding a ferrite core within a layer of a substrate and forming the at least one winding by forming through-holes through the layer of the substrate and a routing connection between the through-holes on or below the layer of the substrate.

In 902, a loop antenna is formed on the layer of the substrate.

In 903, the loop antenna is connected to the at least one winding of the ferrite antenna.

It should be noted that embodiments described in context with the antenna arrangement 800 are analogously valid for the method illustrated in FIG. 9 and vice versa.

In the following, embodiments are described in more detail.

Figure 10:
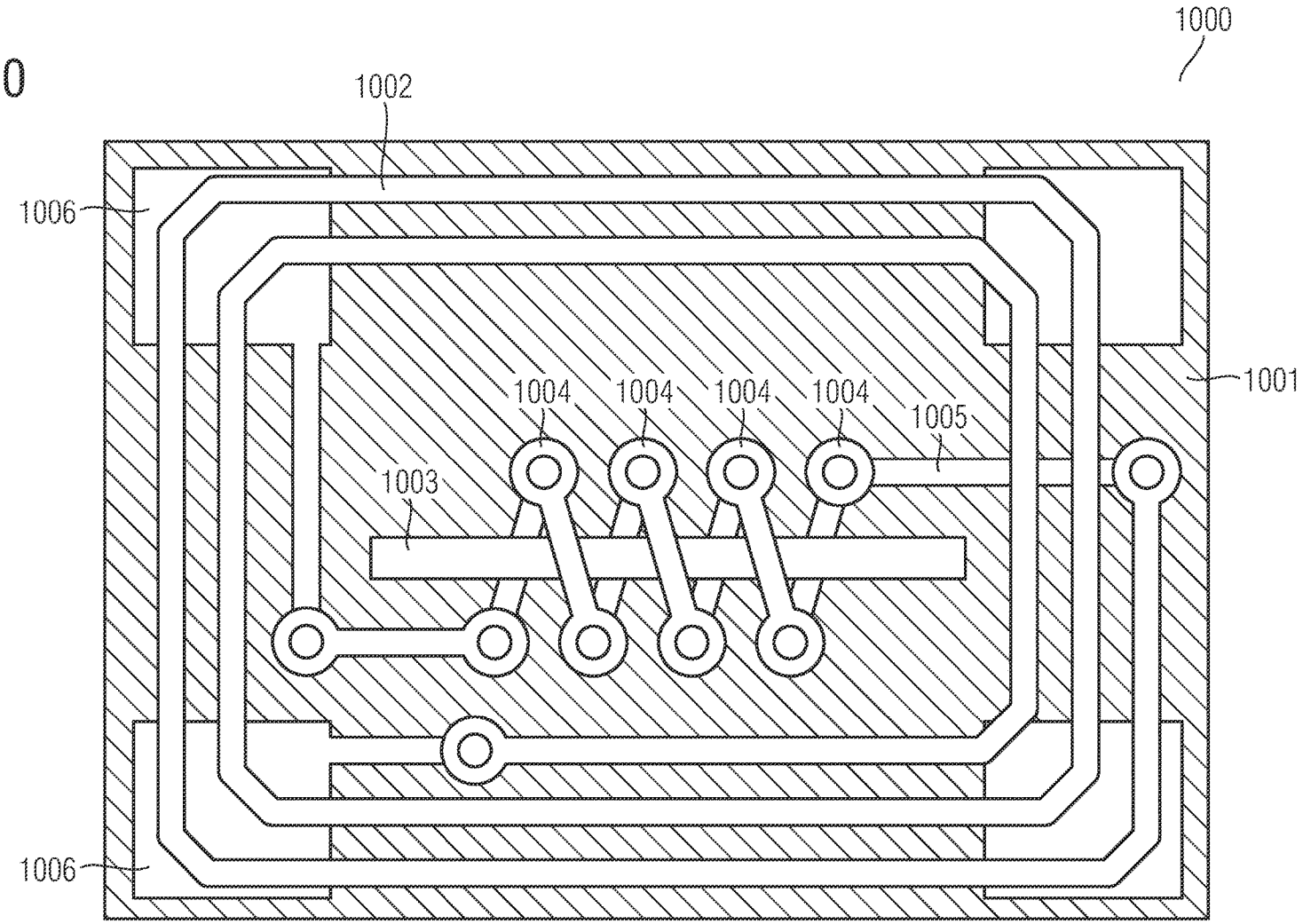
FIG. 10 shows a top view of an antenna arrangement according to an embodiment.

FIG. 10 shows a top view of an antenna arrangement 1000 according to an embodiment.

The antenna arrangement 1000 includes a substrate 1001. A loop antenna 1002 is arranged on a top side of the substrate 1001. Further, the antenna arrangement 1000 includes a ferrite antenna having a ferrite antenna core 1003 which is embedded in the substrate 1001 and which is encircled by a plurality of windings 1004. The loop antenna 1001 is connected to the ferrite antenna via a conductor 1005 for example arranged on the bottom side of the substrate. The serial connection of the loop antenna 1002 and the ferrite antenna has terminals 1006 formed by contact pads arranged on the bottom side of the substrate.

Figure 11:
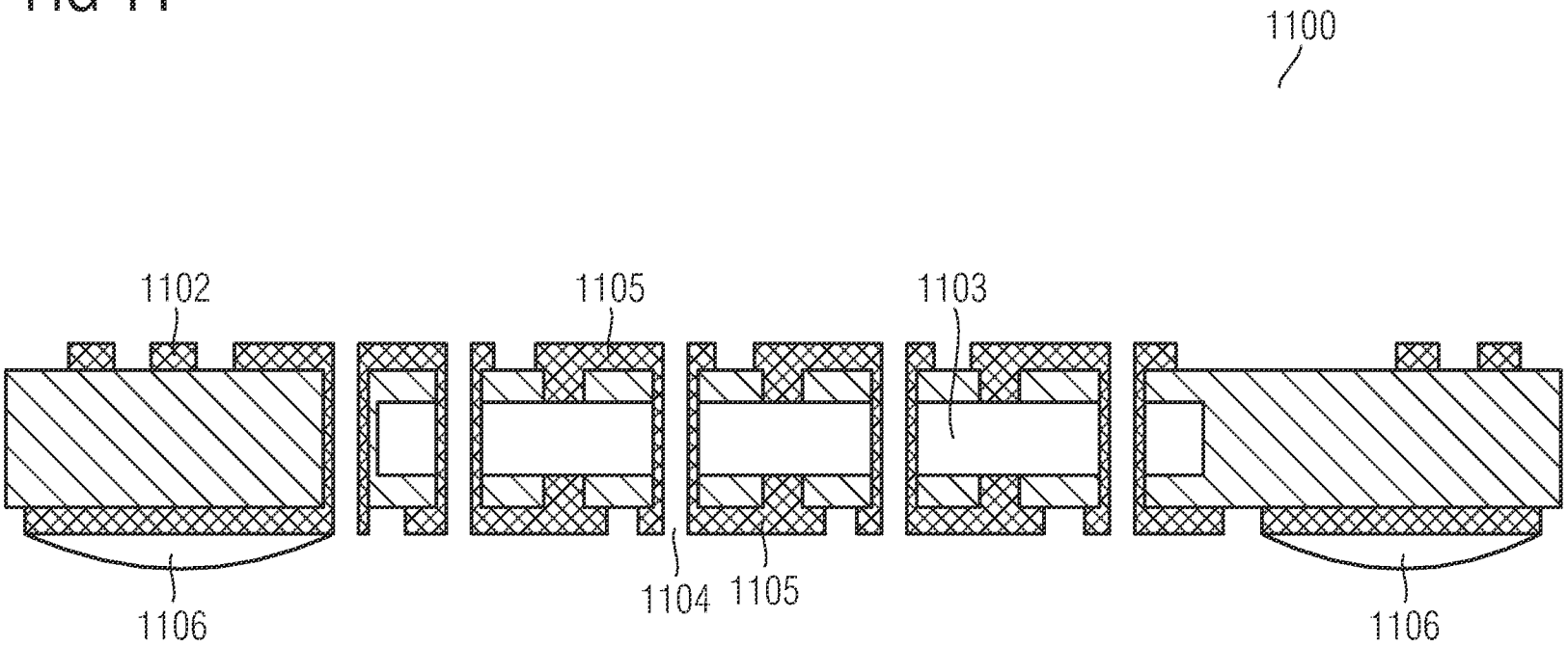
FIG. 11 shows a cross section of an antenna arrangement.

FIG. 11 shows a cross section of an antenna arrangement 1100.

The antenna arrangement 1100 corresponds to the antenna arrangement 1000. Accordingly, it includes a substrate 1101, a loop antenna 1102, embedded ferrite core 1103 and terminals 1106.

The ferrite core 1003, 1103 is for example embedded in a two-sided FR4 laminate core layer.

The loop antenna 1002, 1102 is formed using copper winding on top of the substrate 1001, 1101.

The windings 1004 are formed by through-holes 1104 and copper wiring 1105 on both sides of the substrate 1001, 1101.

Figure 12:
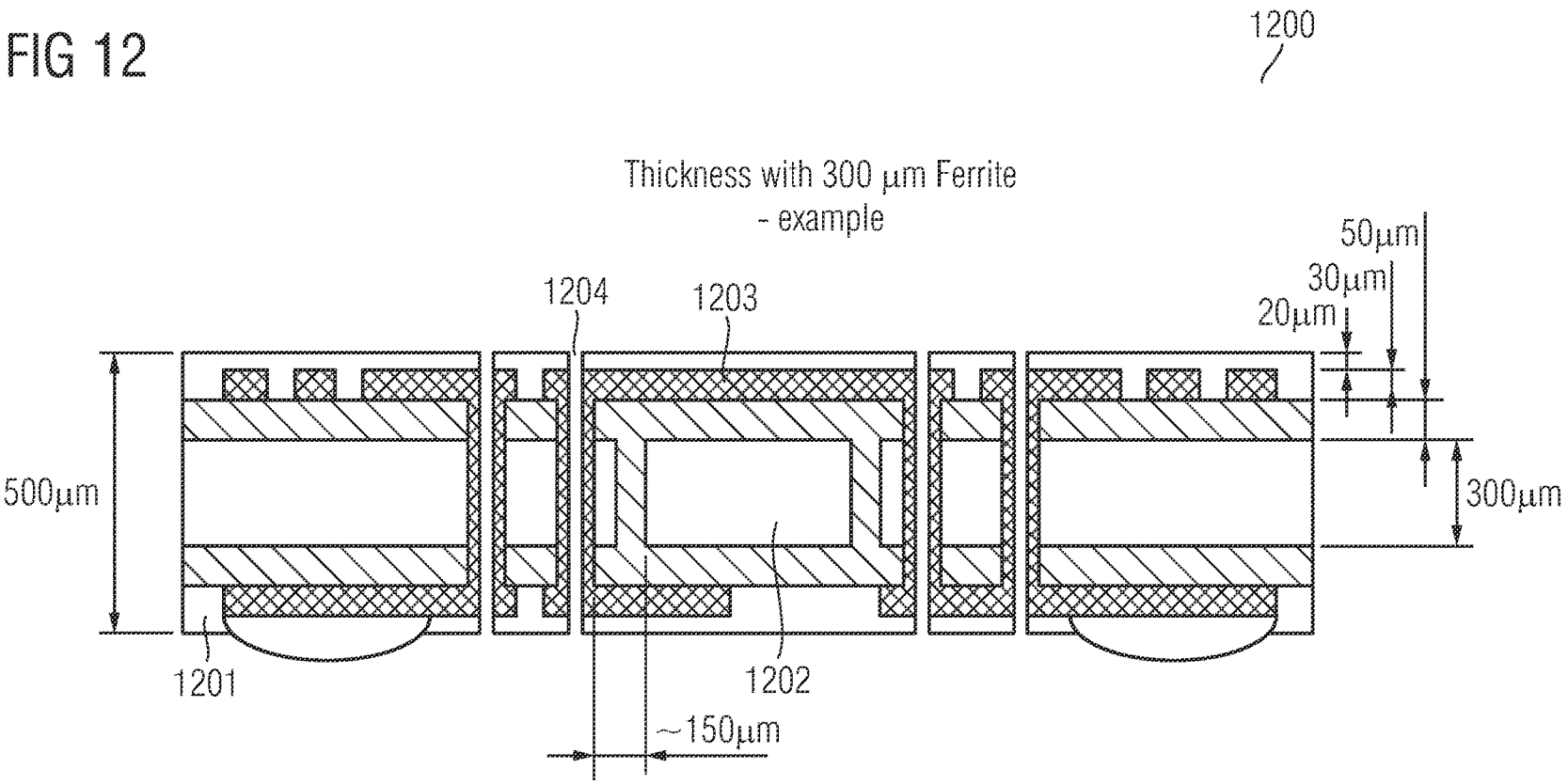
FIG. 12 shows an example for the thickness of the various layers according to one embodiment.

FIG. 12 shows an example for the thickness of the various layers according to one embodiment. The thickness of the substrate 1201, the ferrite core 1202 and the copper wiring 1203 are given as well as the distance between the through-holes 1204 and the ferrite core 1202, the distance between the copper wiring and the ferrite core 1202 and the depth of the copper wiring 1203 in the substrate 1201.

In the following, examples for a process for manufacturing the antenna arrangement illustrated in FIGS. 10 and 11 are given.

Figure 13:
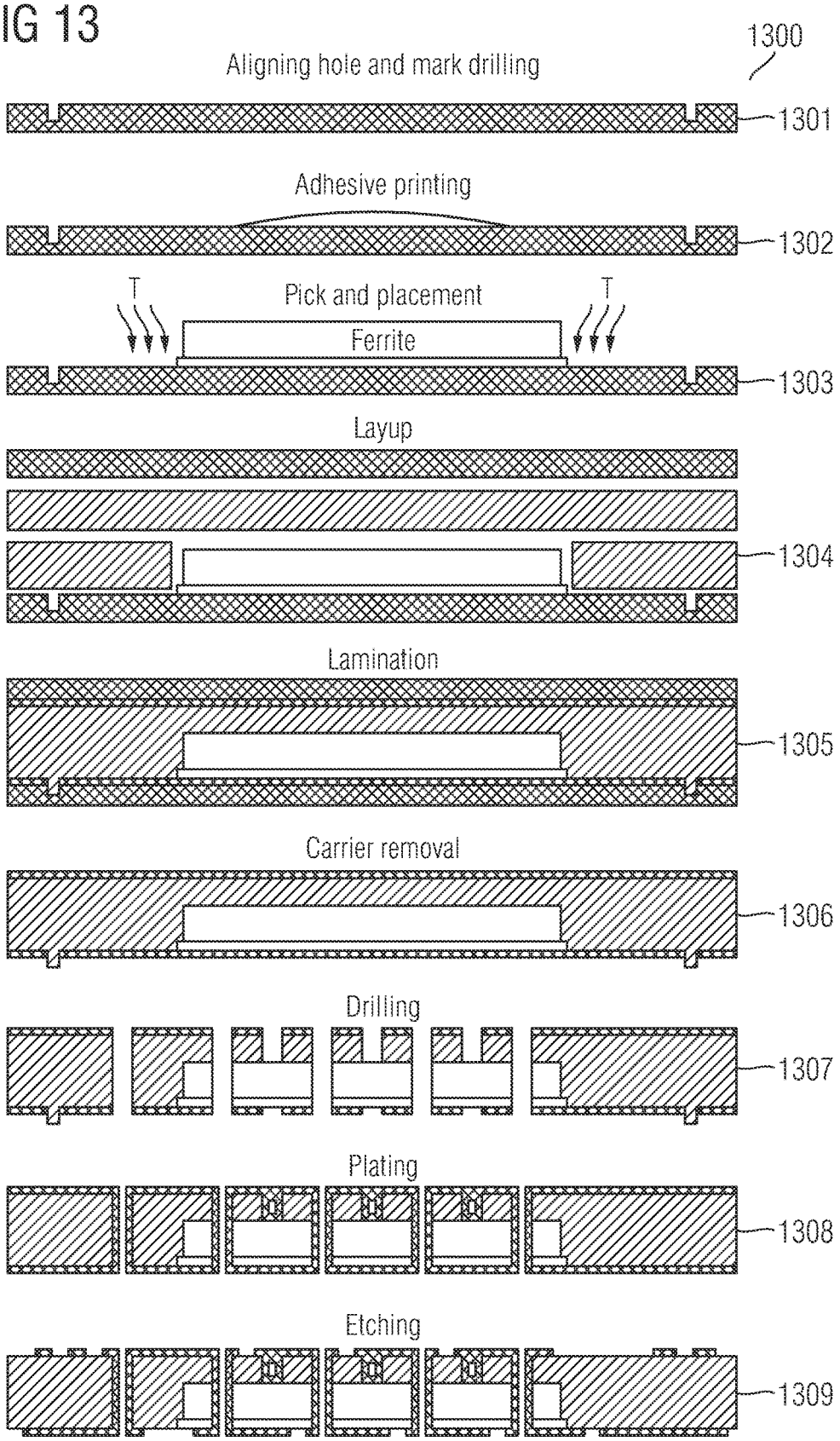
FIG. 13 illustrates a double blade manufacturing process for an antenna arrangement according to one embodiment.

FIG. 13 illustrates a double blade manufacturing process for an antenna arrangement according to one embodiment.

According to the process illustrated in FIG. 13, the ferrite core is bonded to a Cu (copper) foil using isolating adhesive. The Cu foil can be for example two layer copper foil (e.g. Double thin from Circuit foil) where, in 1301, all necessary aligning marks for ferrite mounting and lithography and patterning are manufactured beforehand e.g. with laser drilling process.

In 1302 and 1303, the ferrite is mounted on the foil using a high speed and high capacity SMA (surface mount assembly) line (paste printer, pick and placement machine, reflow oven).

In 1304 and 1305, the ferrite is embedded inside e.g. standard FR4 pre-preg material (e.g. B-stage epoxy resin and Glass fiber reinforcement). The lamination in 1305 is done for using a conventional PCB vacuum lamination machine and process.

After lamination in 1305 and carrier foil removal in 1306, the panel can be handled and treated like a standard two-sided PCB laminate.

In 1307, the through holes to manufacture the wiring around the ferrite and connect the front side to the bottom side are manufactured using a through hole drilling process.

The through holes are plated in 1308 and the wiring is manufactured in 1309 using a double-sided PCB manufacturing process. If needed, the surface can be protected with solder mask and suitable surface finishing. The antenna modules can be separated e.g. using laminate dicing process and mounted to the substrate with e.g. soldering process FIG. 14 illustrates a release tape manufacturing process for an antenna arrangement according to one embodiment.

Figure 14:
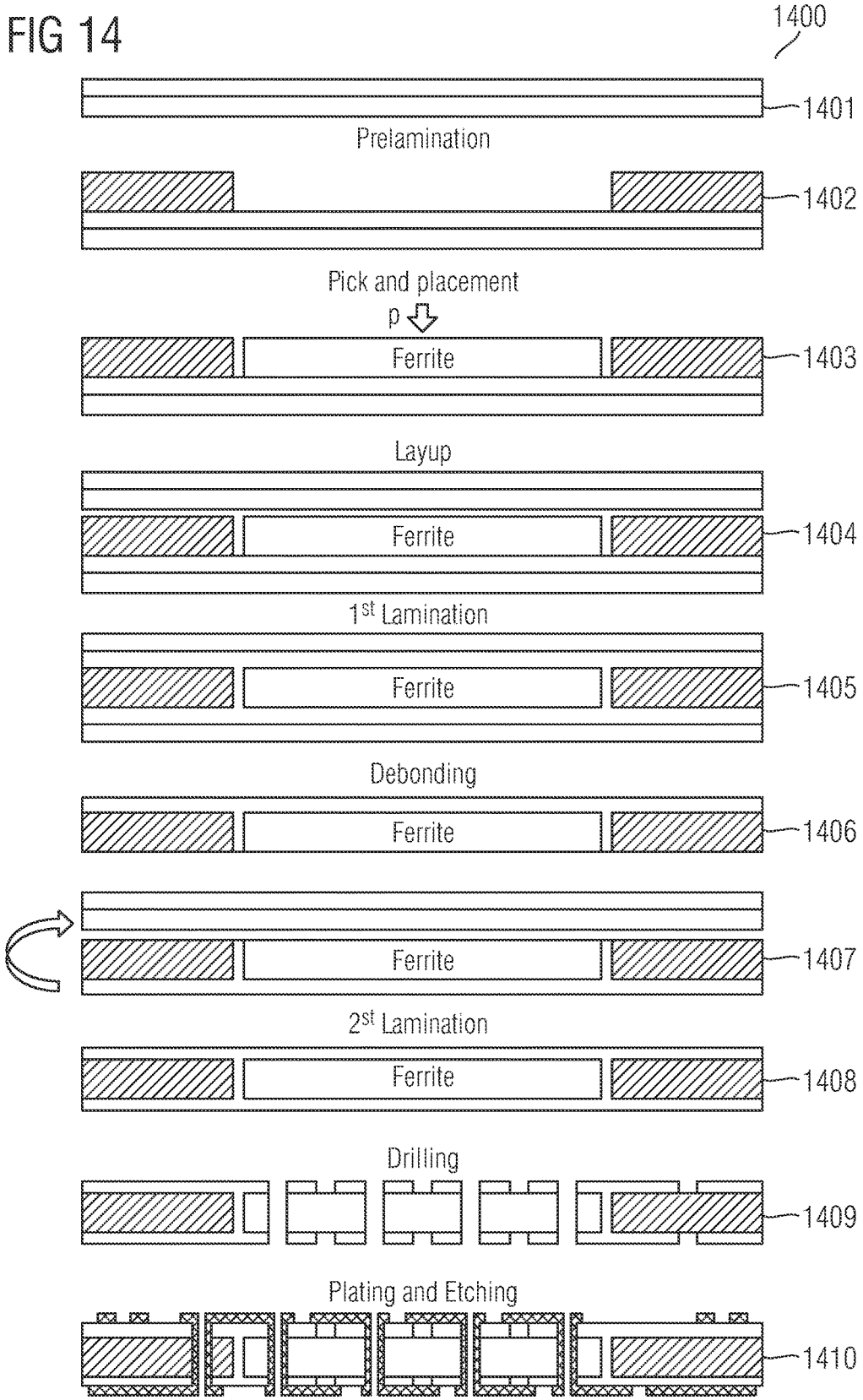
FIG. 14 illustrates a release tape manufacturing process for an antenna arrangement according to one embodiment.

In the process illustrated in FIG. 14, a thermal release tape is used to embed the ferrite core inside a laminate.

In 1401, a low temperature thermal release tape is laminated to a carrier.

In 1402, cured e.g. FR4 core laminate with an opening for the ferrite is placed and fixed to the tape. This laminate layer can also include all necessary aligning marks for following process steps.

In 1403, the ferrite is mounted inside the opening of the core layer and fixed to the release tape using a high speed pick and placement machine.

In 1404 and 1405, e.g. a filled epoxy film (e.g. Hitachi ASZ2, Ebis) with or without Cu foil is prelaminated on top of the core layer. During the prelamination process the resin fills the surrounding around the ferrite and fixes the components to the correct position.

In 1406, after the first lamination process, the thermal release tape and the carrier are removed. The release temperature of the thermal release tape is selected according the epoxy film material and the prelamination temperature.

In 1407 and 1408 another filled epoxy film is laminated to the bottom side of the core layer. The lamination is done using a PCB vacuum lamination process.

In 1409, the through holes to manufacture the wiring around the ferrite and connect the top side conductors to the bottom side conductors are manufactured using a through hole drilling process.

In 1410, the through holes are plated and the wiring is manufactured using a double sided PCB manufacturing process. If needed, the surface can be protected with solder mask and suitable surface finishing. The antenna modules can be separated e.g. using laminate dicing process and mounted to the substrate with e.g. soldering process.

Figure 15:
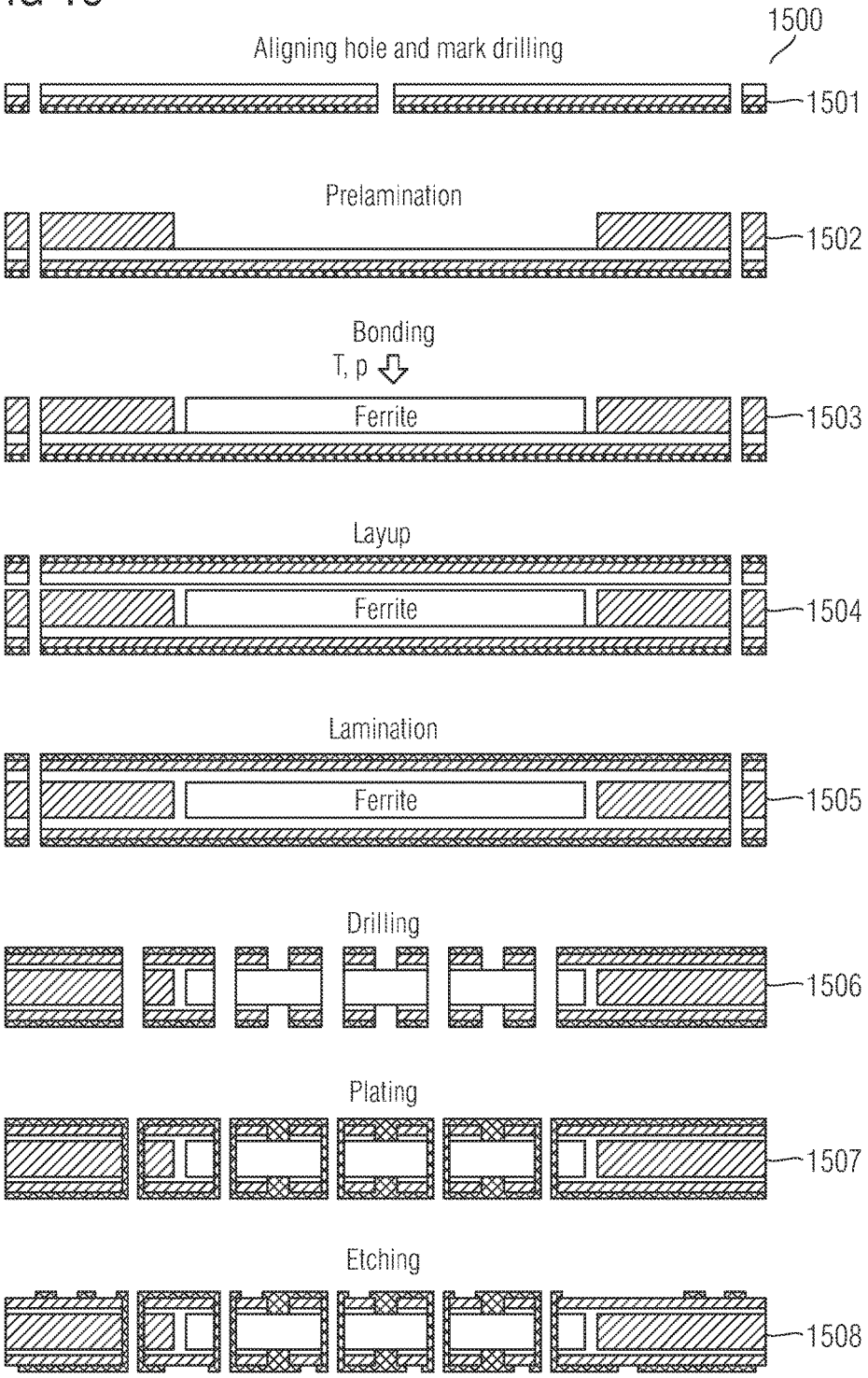
FIG. 15 illustrates a B-stage resin bonding manufacturing process for an antenna arrangement according to one embodiment.

FIG. 15 illustrates a B-stage resin bonding manufacturing process for an antenna arrangement according to one embodiment.

In the process illustrated in FIG. 15, a Chip in Core type manufacturing process is used to embed the ferrite core inside a laminate.

In 1501, a filled resin film is provided with aligning holes and marks for following process steps.

In 1502, the filled resin film is prelaminated to the bottom side of a FR4 core laminate. The core laminate layer can also include all necessary aligning marks for following process steps.

In 1503, the ferrite is mounted inside the opening of the core layer with a pick and placement machine and fixed to the B-stage epoxy film using heat and pressure.

In 1504 and 1505, a filled epoxy film (e.g. Hitachi ASZ2, Zeta lam) with or without Cu foil is prelaminated on top of the core layer.

During the lamination the resin fills the surrounding empty space around the ferrite and fixes the components to the correct position. The lamination is done using a PCB vacuum lamination process. After lamination both steps the carrier films are removed.

In 1506, the through holes to manufacture the wiring around the ferrite and connect the front side to the bottom side are manufactured using a through hole drilling process.

In 1507 and 1508 the through holes are plated and the wiring is manufactured using a double sided PCB manufacturing process. If needed, the surface can be protected with a solder mask and suitable surface finishing. The antenna modules can be separated e.g. using laminate dicing process and mounted to the substrate with e.g. soldering process.

Figure 16:
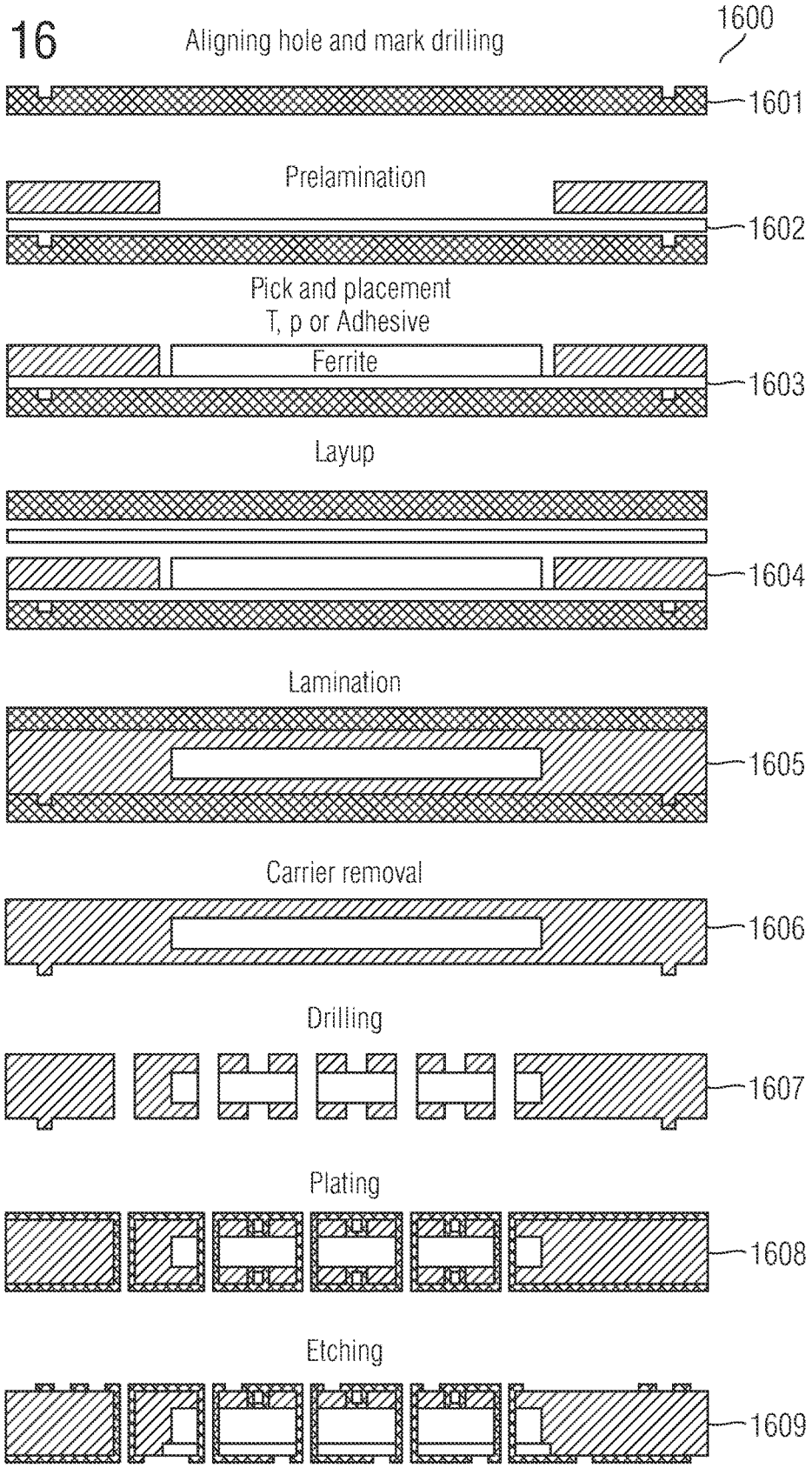
FIG. 16 illustrates a pre-preg bonding manufacturing process for an antenna arrangement according to one embodiment.

FIG. 16 illustrates a pre-preg bonding manufacturing process for an antenna arrangement according to one embodiment.

In the process illustrated in FIG. 16, a standard pre-preg material is used to embed the ferrite core inside a laminate.

In 1601, a Cu foil is provided with aligning holes and marks. The Cu foil can be for example a two layer foil (e.g. Double thin from Circuit foil) where all necessary aligning marks for ferrite mounting and lithography and patterning are manufactured beforehand e.g. with a laser drilling process.

In 1602, the Cu foil, a first pre-preg and a laminate core with openings for the die are aligned and if needed pre-bonded together with pressure and low temperature.

In 1603, the ferrite is mounted in the cavity opening on the laminate using a high speed SMA (surface mount assembly) pick and placement machine. The opening to the core laminate is manufacture accurately using e.g. laser cutting and the size of the opening is only slightly larger than the ferrite core (e.g. 50-100 μm larger than the die). If needed, the ferrite can be fixed to the B-stage pre-preg using heat and pressure.

In 1604 and 1605 a second pre-preg layer and a second (top) Cu foil are mounted on top of the structure and the structure is laminated together using a PCB vacuum lamination process.

After the lamination the carrier foils are removed in 1606.

In 1607 the through holes to manufacture the wiring around the ferrite and connect the top side conductors to the bottom side conductors are manufactured using a through hole drilling process.

In 1608 and 1609 the through holes are plated and the wiring is manufactured using a double sided PCB manufacturing process. If needed, the surface can be protected with solder mask and suitable surface finishing. The antenna modules can be separated e.g. using laminate dicing process and mounted to the substrate with e.g. soldering process.

While specific aspects have been described, it should be understood by those skilled in the art that various changes in form and detail may be made therein without departing from the spirit and scope of the aspects of this disclosure as defined by the appended claims. The scope is thus indicated by the appended claims and all changes which come within the meaning and range of equivalency of the claims are therefore intended to be embraced.

What is claimed is:

1. A hybrid antenna comprising a plurality of windings wherein each winding comprises a loop antenna portion arranged in a plane and a ferrite antenna portion arranged at least partially outside of the plane, wherein the ferrite antenna portions are ferrite antenna windings surrounding a ferrite antenna core, wherein the ferrite antenna windings and the ferrite antenna core form a ferrite antenna, and wherein for each winding the ferrite antenna comprises a first terminal and a second terminal connected via the ferrite antenna portion and the loop antenna portion is connected to the ferrite antenna portion via the first terminal and the second terminal.

2. The hybrid antenna of claim 1, wherein at least one winding of the plurality of windings comprises a ferrite antenna portion formed by a plurality of ferrite antenna windings.

3. The hybrid antenna of claim 1, wherein the plane is a layer or a surface of a substrate.

4. The hybrid antenna of claim 1, wherein the plane is a layer or a surface of a printed circuit board.

5. The hybrid antenna of claim 3, wherein the windings encircle an area of the substrate which is at least partially free of ferrite.

6. The hybrid antenna of claim 1, wherein the ferrite antenna portion arranged at least partially outside of the plane is arranged substantially perpendicular to the plane.

7. The hybrid antenna of claim 1, wherein at least one winding of the plurality of windings comprises a ferrite antenna portion which comprises a higher number of conductors outside of the plane than it comprises conductors in the plane.

8. The hybrid antenna of claim 1, wherein the conductors outside of the plane are conductors on top of a ferrite antenna core and the conductors in the plane are conductors below the ferrite antenna core.

9. An antenna arrangement comprising:

a substrate;

a loop antenna formed on a layer of the substrate;

a ferrite antenna comprising a ferrite core embedded within the layer of the substrate and comprising at least one winding, wherein the loop antenna is connected to the at least one winding and the at least one winding is formed by through-holes through the layer of the substrate and a routing connection between the through-holes on or below the layer of the substrate.

10. The antenna arrangement according to claim 9, wherein the ferrite core is disposed in a recess of the layer of the substrate.

11. The antenna arrangement according to claim 9, wherein the through-holes and the routing connection are arranged such that the at least one winding encircles the ferrite core.

12. The antenna arrangement according to claim 9, wherein the through-holes comprise a conductive material.

13. The antenna arrangement according to claim 9, wherein the through-holes are plated with conductive material or filled with conductive material.

14. The antenna arrangement according to claim 9, wherein the at least one winding is formed by two through-holes and a routing connection arranged on the layer connecting the through-holes and a routing connection arranged below the layer connecting one of the through-holes to a further through-hole or is formed by two through-holes and a routing connection arranged below the layer connecting the through-holes and a routing connection arranged on the layer connecting one of the through-holes to a further through-hole.

15. The antenna arrangement according to claim 9, wherein the loop antenna encloses an area of the substrate in which the ferrite antenna core is embedded.

16. The antenna arrangement according to claim 9, wherein the substrate is a laminate.

17. The antenna arrangement according to claim 9, comprising a plurality of windings, wherein each winding is formed by through-holes through the layer of the substrate and a routing connection between the through-holes on or below the layer of the substrate.

18. The antenna arrangement according to claim 17, further comprising further routing connections on or below the layer of the substrate serially connecting the plurality of windings.

19. A method for manufacturing an antenna arrangement comprising:

forming a ferrite antenna with at least one winding by embedding a ferrite core within a layer of a substrate; and forming the at least one winding by forming through-holes through the layer of the substrate and a routing connection between the through-holes on or below the layer of the substrate;

forming a loop antenna formed on the layer of the substrate; and connecting the loop antenna to the at least one winding of the ferrite antenna.

20. The antenna arrangement according to claim 1, wherein each ferrite antenna portion of the plurality of windings are arranged laterally proximate to one another along a common axis.

21. The antenna arrangement according to claim 1, wherein the ferrite antenna portion encircles ferrite and the loop antenna portion is free of ferrite.

22. The antenna arrangement according to claim 9, wherein distal ends of the loop antenna are connected to distal ends of the ferrite antenna.

23. The antenna arrangement according to claim 9, wherein the loop antenna is connected in series with the ferrite antenna.

* * * * *